US006725925B2

(12) United States Patent
Al-Ramadhan

(10) Patent No.: US 6,725,925 B2
(45) Date of Patent: Apr. 27, 2004

(54) DOWNHOLE CATHODIC PROTECTION CABLE SYSTEM

(75) Inventor: Abdul-Raouf M. Al-Ramadhan, Udhailiyah (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 10/134,053

(22) Filed: Apr. 25, 2002

(65) Prior Publication Data

US 2003/0201100 A1 Oct. 30, 2003

(51) Int. Cl.[7] ..... E21B 41/02; E21B 42/00

(52) U.S. Cl. ..... 166/250.05; 166/248; 166/65.1; 166/242.4

(58) Field of Search ..... 166/248, 250.05, 166/313, 381, 65.1, 242.1, 242.4, 242.6, 75.13, 242.2

(56) References Cited

U.S. PATENT DOCUMENTS 1,608,709 A * 11/1926 Milles ..... 205/731
3,220,942 A * 11/1965 Crites ..... 205/731
3,234,723 A * 2/1966 Brown ..... 57/222
3,417,823 A * 12/1968 Faris ..... 166/248
4,289,199 A * 9/1981 McGee ..... 166/65.1
4,525,263 A * 6/1985 Parkhurst et al. ..... 205/724
4,786,388 A * 11/1988 Tatum, Jr. ..... 204/196.21
5,080,773 A * 1/1992 Tatum et al. ..... 204/196.34
5,547,020 A * 8/1996 Sable et al. ..... 166/65.1
6,021,095 A * 2/2000 Tubel et al. ..... 367/82
6,131,659 A * 10/2000 Johnson ..... 166/250.05

* cited by examiner

*Primary Examiner*—David Bagnell
*Assistant Examiner*—Jennifer H Gay
(74) *Attorney, Agent, or Firm*—Abelman, Frayne & Schwab

(57) ABSTRACT

A downhole cathodic protection cable system includes an attachment shoe electrically connected to a metallic structure at a distance substantially below the earth's surface, and an electrical cable having a first end connected to a connection structure substantially at the earth's surface and a second end electrically connected to the attachment shoe. The first end is connected through the connection structure to provide current to the cable sufficient to prevent substantial corrosion surrounding the attachment shoe.

20 Claims, 5 Drawing Sheets

DOWNHOLE CATHODIC PROTECTION CABLE SYSTEM

FIELD OF THE INVENTION

This invention relates to cathodic protection of metallic structures such as the casings of oil, water and gas wells at large distances below the well head.

BACKGROUND OF THE INVENTION

The process of corrosion of a metallic structure is essentially an electrolytic process involving the loss of electrons from the structure, for which an electrolyte is necessary. In the case of a metallic structure within the ground, such as the casing of an oil, water or gas well, the moist earth and/or subterranean water pockets act as the electrolyte. It has been found that without corrosion protection, these casings corrode and develop cracks and leaks.

One type of conventional corrosion protection involves putting a protective external coating on the casing. This method is available only for new wells.

However, it has been found that the cathodic elements of a metallic structure corrode less than the anodic elements. Therefore, another conventional method of corrosion protection in this environment is to attach a cathodic protection cable to the well head, at the surface, to supply current to the wellhead and thereby seek to render the entire metallic structure cathodic, i.e. negatively charged with respect to the surrounding earth. While this method works well for metallic portions of the structure at the surface, it has been found to be ineffective for those portions of the well structure at significant distances below the well head. This is so even when the amount of current is substantially increased or even doubled.

SUMMARY OF THE INVENTION

It is therefore an object of the present invention to provide corrosion protection for metallic structures at significant distances below the earth's surface that avoids the above-described difficulties of the prior art.

It is a more specific object of the present invention to provide effective corrosion protection for well casings at significant distances below the well head.

It is a further object of the present invention to provide effective cathodic corrosion protection for well casings at significant distances below the well head.

It is another object of the present invention to provide cathodic corrosion protection that is safe to use for well casings at significant distances below the well head.

The above and other objects are achieved by the present invention which, in one embodiment, is directed to a downhole cathodic protection cable system for providing cathodic protection to a metallic structure below the earth's surface. The system comprises an electrical connection structure approximately at the earth's surface, an attachment shoe electrically connected to the metallic structure at a distance substantially below the earth's surface, and an electrical cable having first and second ends, the first end being connected to the connection structure and the second end being electrically connected to the attachment shoe. The first end of the cable is electrically connected through the connection structure to a current source for providing a current to the cable sufficient to prevent substantial corrosion of a portion of the metallic structure surrounding the attachment shoe.

In accordance with an advantageous aspect of the present invention, the distance of the attachment shoe below the earth's surface is greater than a distance at which a current supplied to the metallic structure at the earth's surface can effectively prevent substantial corrosion, for example on the order of thousands of feet.

In a preferred embodiment, the attachment shoe provides a sturdy mechanical attachment of the second end of the cable to the metallic structure.

In a further preferred embodiment, the metallic structure includes the inner casing and outer casing of a well, the attachment shoe is connected to the inner casing, and the cable runs between the inner and outer casings from the attachment shoe up to a point substantially at the earth's surface.

The downhole cathodic protection cable in accordance with the present invention provides cathodic protection to the deeper portions of the casing that cannot be protected using the conventional cathodic protection surface connection. It can be used in new wells and in existing wells by running the cable behind the well production tubing and then connecting it to the existing casing.

Moreover, the downhole cathodic protection cable in accordance with the present invention also provides cathodic protection above as well as below the point where the cable is connected to the casing.

A primary benefit of the downhole cathodic protection cable in accordance with the present invention is that it can prevent or minimize the occurrence of casing leaks, which can cost hundreds of thousands of dollars for repairs each year, as well as losses in oil production or water injection These and other objects, features and advantages of the present invention will be apparent from the following detailed description of the preferred embodiments taken in conjunction with the following drawings, wherein like reference numerals denote like elements.

DETAILED DESCRIPTION OF THE PREFERRED EMBODIMENTS

Figure 1:
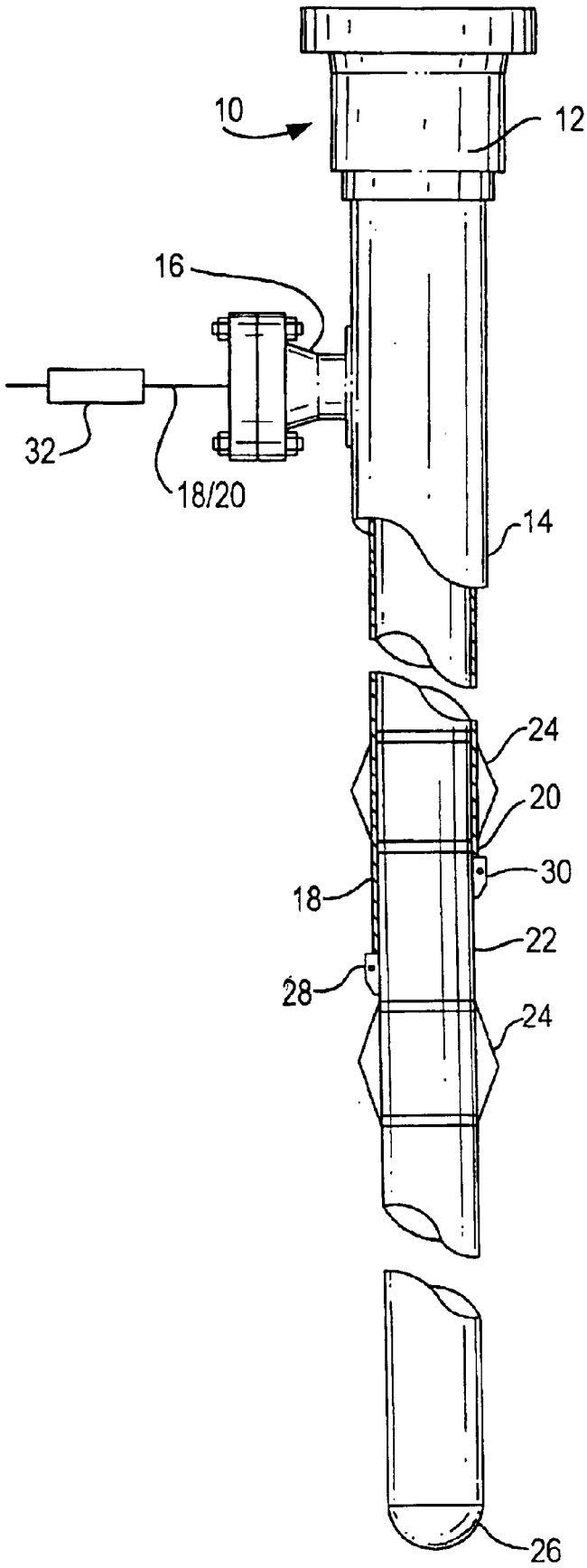
FIG. 1 is a side view, partially cut away, of a well casing and downhole cathodic protection cable in accordance with a preferred embodiment of the present invention.

With reference to FIG. 1, a well installation is shown using two downhole cathodic protection cables in accordance with the present invention. The well installation is constructed of a casing head 10 positioned at or close to the earth's surface and consisting of a landing base 12 and a downwardly extending outer conductor casing 14. A novel well head outlet 16 pierces the conductor casing 14 to provide an entry for both a primary cathodic protection cable 18 and a back-up cathodic protection cable 20.

Running down the well inside the conductor casing 14 is an inner casing 22. The casings 14, 22 can extend downwardly for many thousands of feet below the landing base 12. Conventionally, the conductor casing 14 has a diameter of 13-⅜" and the inner casing 22 has a diameter of 9-⅝". The two cables 18, 20 are run up the outer diameter of the inner casing 22, which is centralized at every joint by a corresponding centralizer 24. The centralizers 24 prevent damage to the cables 18, 20 while running in the well hole.

The inner casing 22 terminates at its lower end in a casing shoe 26.

The primary cable 18 is electrically connected at its lower end to the inner casing 22 by a novel attachment shoe 28, which will be described below. The back-up cable 20 is electrically connected at its lower end to the inner casing 22 by a corresponding attachment shoe 30 having the same structure as the attachment shoe 28. It is an advantageous feature of the present invention that the novel attachment shoes 28, 30 provide good electrical contact with the inner casing 22 as well as a mechanically sound connection, so that the cables 18, 20 will not pull out of the attachment shoes 28, 30 while the inner casing 22 is being run.

The attachment shoes 28, 30 can be attached at any desired depth within the well in order to provide the desired cathodic protection downhole. In a test of a preferred embodiment of the cable described below, the attachment shoes 28, 30 were connected to the inner casing 22 at a depth of approximately 4,000 feet. In general, the present invention is advantageous in that the distance of the attachment shoes below the earth's surface can be greater than the distance at which a current supplied to the casing at the earth's surface can effectively prevent substantial corrosion. In this example, the distance of the attachment shoes below the earth's surface is more than 1,000 feet, and may be on the order of thousands of feet.

The cables 18, 20 exit the casing head 10 through the outlet 16 fabricated to the conductor casing 14 below the landing base 12. Once outside of the outlet 16, the upper ends of the cables 18, 20 are connected to a junction box 32. The junction box 32 serves as a connection structure for connecting the upper ends of the cables 18, 20 to a current (power) source (not illustrated) that supplies the desired voltage and current sufficient to prevent substantial corrosion of a portion of the inner casing 22 surrounding the attachment shoes 28, 30. As indicated by the test results given below, this protected portion can extend for hundreds or thousands of feet.

Figure 2:
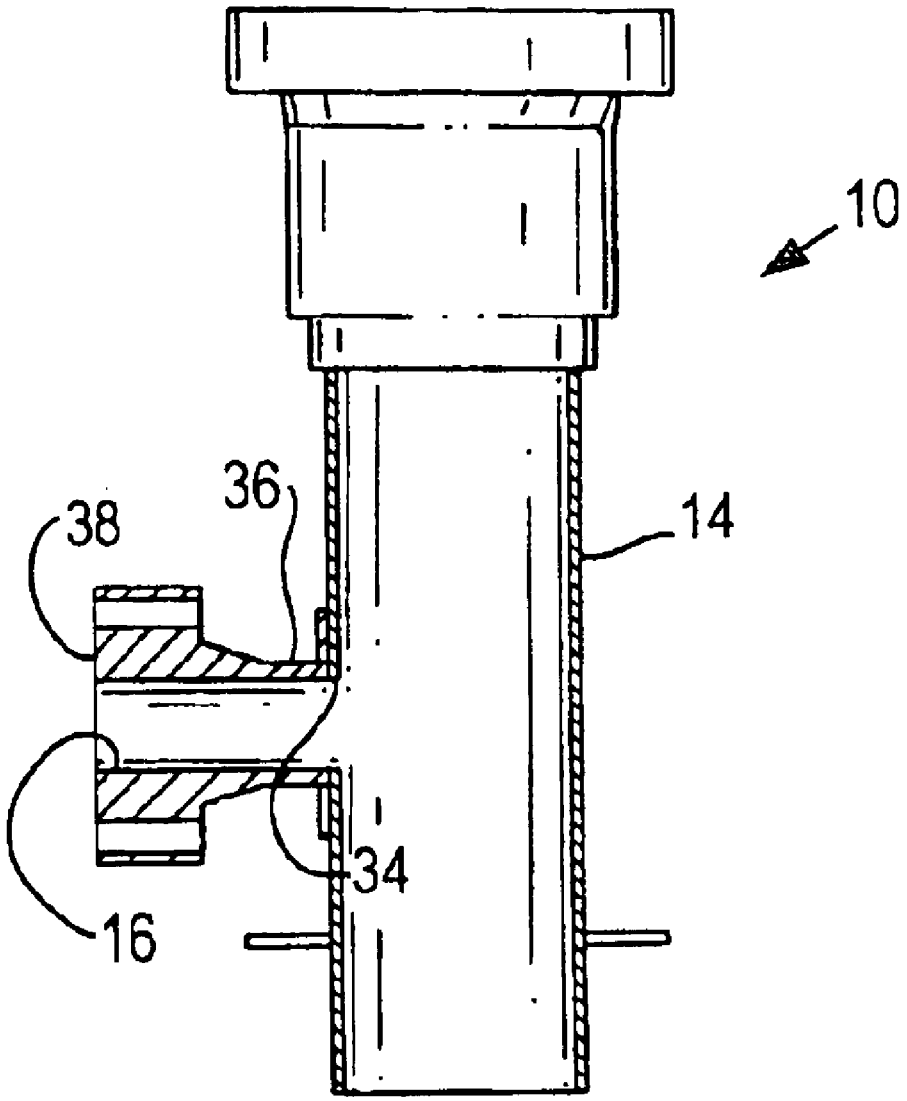
FIG. 2 is a cross-sectional view of the wellhead penetrator for the cable of FIG. 1.

FIG. 2 illustrates the casing head 10. In a preferred embodiment for a Power Water Injection well, for example, the casing head 10 may be a standard 13"3M×13-⅜" SOW Casing Head modified by installing a 13-⅜" 72# nipple with the fabricated 7" 3M outlet 16.

Figure 3:
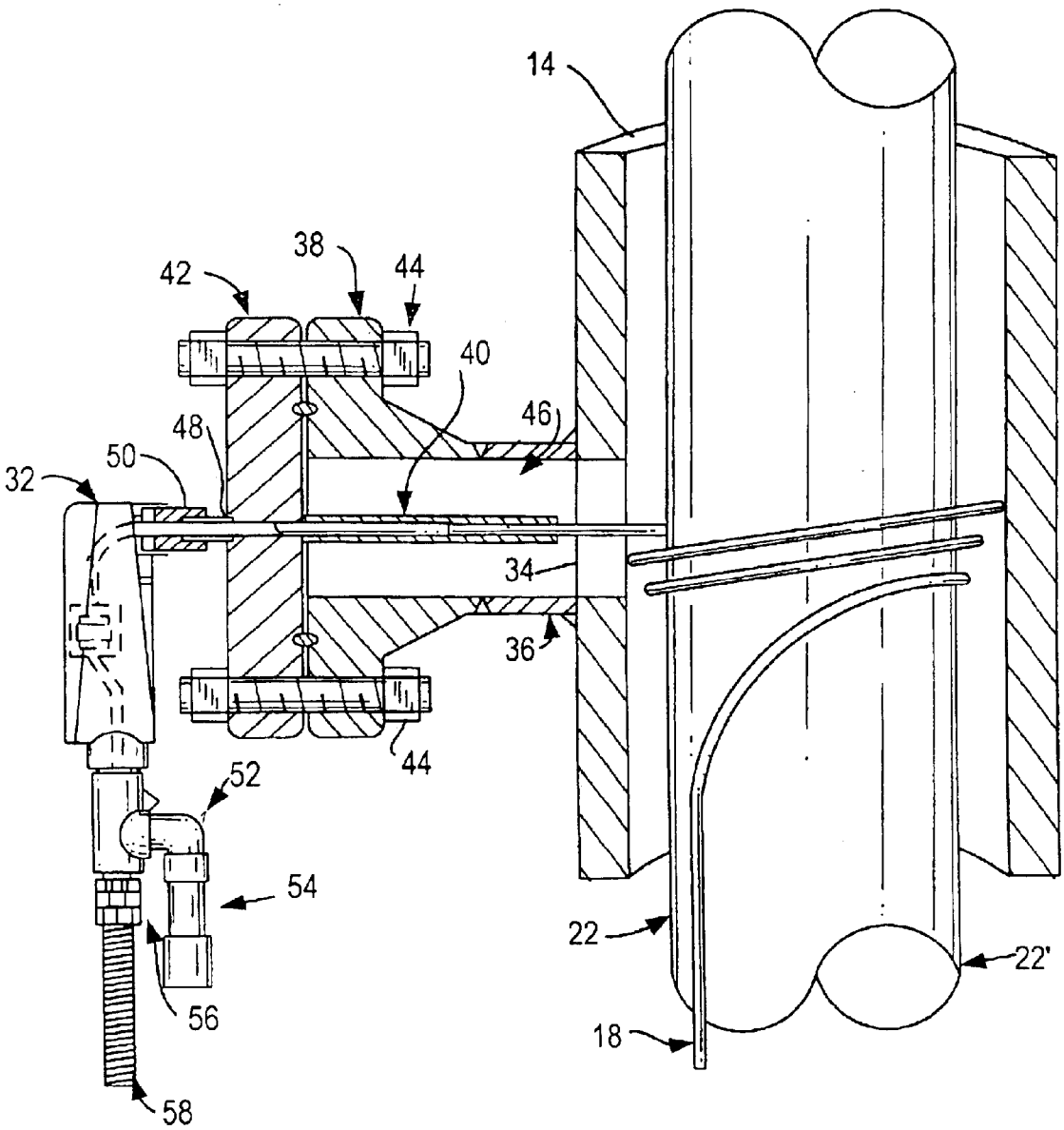
FIG. 3 is a side cross-sectional view of the wellhead penetrator of FIG. 2 in position in the well head.

As shown in FIG. 2, a circular opening 34 that is 6" in diameter is made in the conductor casing 14 and a pipe extension 36 is fabricated thereto. The pipe extension 36 is 3" long. A 7"-3M weld-neck flange 38 is attached to the outer end of the pipe extension 36. Further structure relating to the outlet 16 in a preferred embodiment is shown in greater detail in FIG. 3, which is a schematic of the well head penetrator 40 in the outlet 16. As shown therein, the conductor casing 14 surrounds the inner casing, which in this embodiment is formed of two inner casings 22, 22' for the two pipes of this water well structure. A 7"-3M blind flange 42 is connected to the weld-neck flange 38 by bolts 44 to seal the cavity 46 of the weld-neck flange 38. An opening 48 through the blind flange 42 permits entry of the penetrator 40 therethrough.

The cables 18, 20 pass from outside of the outlet 16 through the penetrator 40 to inside the conductor casing 14 to wrap around the outside diameter of the inner casings 22, 22' and thence downhole. In a preferred embodiment, the penetrator 40 is a 12MM penetrator from Genco/Quick Connectors Inc. that is rated to 3,000 psi working pressure and carries a NEMA (National Electrical Manufacturers Association) Class 1 Div. 2 explosion proof rating.

Extending out from the blind flange 42, the penetrator 44 mates with a ½" NPT nipple 50, which in turn mates with the 1" LB6X junction box 32. Extending from the junction box 32 through an elbow 52 is a listed vent 54. A ¾" Hawke cable gland 56 connects a CLX surface cable 58, three conductor #12 AWG, to the junction box 32 for connection to the cable 18. The cathodic protection power source (not illustrated) is connected to the cables 18, 20 through the cable 58.

In one embodiment, cables 18, 20 are 6 AWG cathodic protection cable purchased from Judd Wire. However, depending on the application, larger and/or armored cable may be preferable.

For other applications, modifications in the structure of the outlet may be made. For example, in the above-described structure, there is a weight limitation of 500 kips axial load on the nipple. There are several possible remedies for this weight limitation. One would be to use a ring forging with a 7" 3M side outlet instead of fabricating an outlet to the casing. A thick walled forging would raise the allowable load and support all subsequent casing and tubing strings. Another possibility would be to purchase casing heads with a 7"3M outlet. A determination of which structure is most appropriate for a particular application would consider both the structural requirements and the cost.

Figure 4:
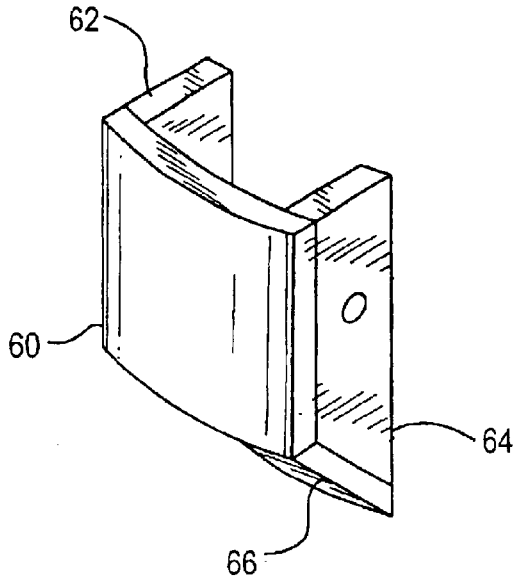
FIG. 4 is a perspective view of the attachment shoe for the cable of FIG. 1.
Figure 5:
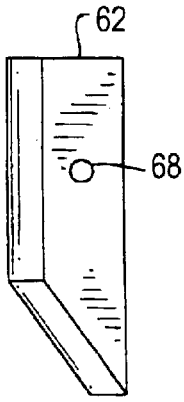
FIG. 5 is a perspective view of a side of the attachment shoe of FIG. 3.
Figure 6:
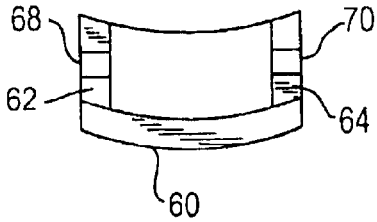
FIG. 6 is a top view of the attachment shoe of FIG. 3.

FIGS. 4–6 illustrate the attachment shoe 28 for attaching cable 18 to the casing 22, where the attachment shoe 30 for attaching cable 20 to the casing 22 has the identical structure. This novel attachment shoe 28 provides an advantageous electrical connection through the casing slip and thereby avoids otherwise severe safety problems with exiting the cables 18, 20 through the casing head 10.

FIG. 4 is a perspective view of the attachment shoe 28. The attachment shoe 28 includes a front wall 60, opposing side walls 62, 64 and a bottom wall 66, all made of a conductive material. FIG. 5 is a perspective view of side wall 62 (or side wall 64 ), and FIG. 6 is a top view of the attachment shoe 28. Extending through side wall 62 is a bolt hole 68, and extending through side wall 64 is a corresponding bolt hole 70. The bottom wall 66 of the attachment shoe 28 is angled to help centralize the casing 22 when running and to prevent hang-ups.

To connect the cable 18 to the casing 22, first the attachment shoe 28 is welded to the casing 22. A bolt (not illustrated) is passed through bolt holes 68, 70 and the end of the cable 18 is fastened to the bolt, for example by forming the end of the cable 18 into a hook or ring (not illustrated) that passes around the bolt. Then the hollow of the attachment shoe 28 between the side walls 62, 64 and between the front wall 60 and the casing 22 is filled with liquid solder, which is allowed to harden. The rest of the cable 18 is wrapped around the outside diameter of the casing 22 down the well hole.

In a pull test on this attachment shoe 28, a 300 pound pull was applied to the cable 18. It was found that the cable 18 was secure and the attachment as a whole was mechanically sound.

The downhole cathodic protection system using the above-described structure was tested. The first step was to weld the two attachment shoes 28, 30 to the casing 22. Both shoes 28, 30 were attached to the same joint, one at the bottom and the other at the top, radially spaced 180 degrees apart.

The second step was to bolt the cables 18, 20 to the insides of the respective shoes 28, 30 and to fill the shoes with solder to provide the strong mechanical connection and good electrical connectivity. Immediately after the cables were attached, a check with a continuity meter confirmed this good electrical connectivity to the casing 22.

The casing 22 was run in the well bringing the cables 18, 20 up the outer diameter and banded with nylon bands at the bottom and middle of each joint. Centralizers were run on each joint and electrical continuity checked after each connection. Special care was taken to prevent pinching of the cables in the floor slips. The final installed depth of the cables 18, 20 was approximately 4,000 feet.

After the casing 22 was run to setting depth and cemented, the BOP stack was picked up and the cables 18, 20 pulled through the outlet 16 fabricated into the conductor casing 14. The casing hanger was then installed and casing hung-off.

The penetrator 40 was installed by crimping an end conductor to each cable, installing the pressure isolation boot, pulling the penetrator 40 through the blind flange 42 and bolting the blind flange 42 in place with bolts 44. Finally, the explosion proof junction box 32 was installed and the installation completed.

In the test, two logs, a CEPT log and an Ultrasonic Imaging Tool (USI), were run. The cathodic protection system for the well casing had been energized for several months prior to conducting the logs.

Figure 7:
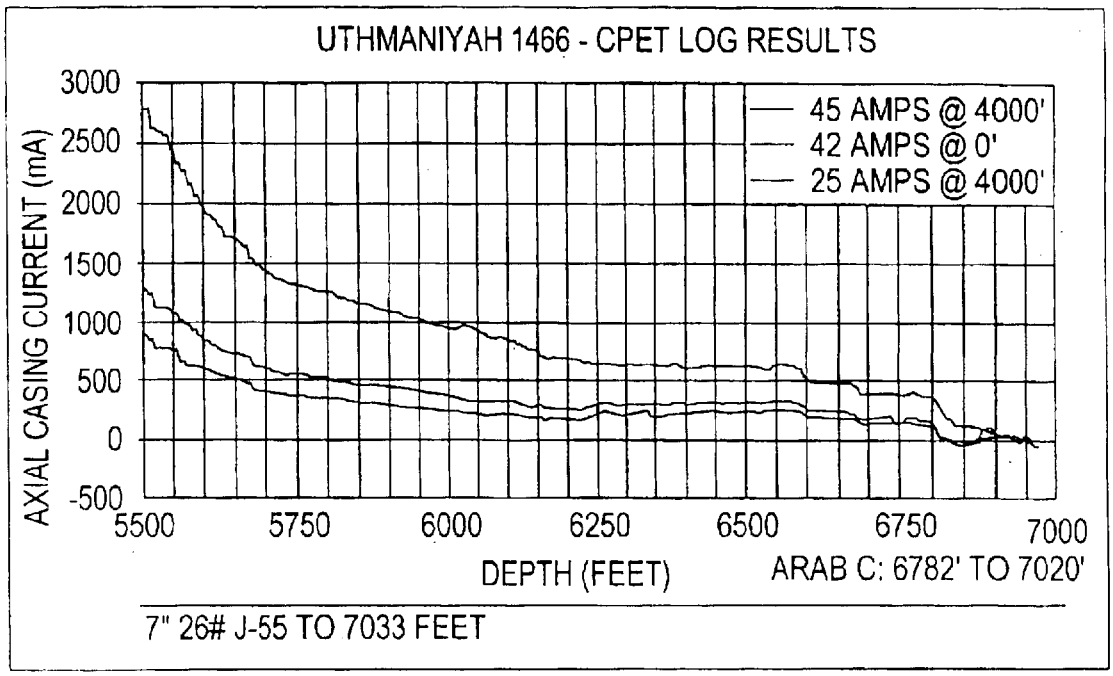
FIG. 7 is a Corrosive Protection Evaluation Tool (CPET) log of three runs of a test of the downhole cathodic protection cable in accordance with the present invention.

FIG. 7 shows the results of the CEPT test. Three passes were run with the CPET to delineate the relative performance of the downhole cable connection through a corrosive region having a top at 6782 feet, as follows:

| PASS NO. | RECTIFIER | NEGATIVE CABLE CONNECTED AT |
|---|---|---|
| 1 | 45 amps | 4,000 feet |
| 2 | 42 amps | 0 feet (surface) |
| 3 | 25 amps | 4,000 feet |

Pass No. 1

The cathodic protection system was operated at an output of 45 amps, collecting cathodic protection current through the downhole cable connection at approximately 4,000 feet down the casing. The log revealed that cathodic protection was adequate through the corrosive region.

The direction of the slope between 3650 feet and 2500 feet may have been indicative of slight interference, but this could not be substantiated due to the multiple casing configuration. Increasing the downhole cable size or using both cables would significantly reduce the probability of detrimental interference.

Detailed Log Observations:

1) 6950' to 6900'—The log illustrated slight DC current collecting on the casing (no corrosion and possibly a small amount of cathodic protection).
2) 6900' to 6850'—The log illustrated a slight increase in current collecting on the casing (no corrosion and an improvement in cathodic protection).
3) 6850' to 6830'—The log illustrated a very short flat section (no corrosion, but no accumulation of cathodic protection current).
4) 6830' to 6800'—The log illustrated a pronounced cathodic slope indicating a substantial accumulation of cathodic protection current and no corrosion.
5) 6800' to 5500'—The log illustrated a complete cathodic slope, increasing exponentially as it moved up the casing.

Pass No. 2

The downhole negative connection to the cathodic protection rectifier was replaced with a surface connection to the well head, and the rectifier was readjusted to supply, as near as possible, the same current as provided during Pass No. 1. With 42 amps of current supplied to the surface connection, the log revealed a pronounced anodic slope in the corrosive region, indicating casing corrosion. Thus, 42 amps of current supplied through the surface connection were not adequate to mitigate corrosion in the corrosive region.

Detailed Log Observations:

1) 6950' to 6890'—The log illustrated a slight cathodic slope indicative of cathodic protection accumulation and no corrosion.
2) 6890' to 6850'—The log illustrated a pronounced anodic slope indicative of inadequate cathodic protection and casing corrosion.
3) 6850' to 6800'—The log illustrated a pronounced cathodic slope indicating accumulating cathodic protection current and no corrosion.
4) 6800' to 5500'—The log illustrated a complete cathodic slope, increasing exponentially as it moved up the casing.

Pass No. 3

The surface negative connection to the cathodic protection rectifier was replaced with the downhole connection, and the rectifier was readjusted to supply 25 amps of cathodic protection current. With 25 amps of current supplied to the downhole connection, the log revealed a pronounced anodic slope in the corrosive region, indicating casing corrosion. The results were almost identical to those of Pass No. 2. Thus, 25 amps of current supplied through the downhole connection were not adequate to mitigate corrosion in the corrosive region.

Detailed Log Observations:

1) 6950' to 6890'—The log illustrated a slight cathodic slope indicative of cathodic protection accumulation and no corrosion.
2) 6890' to 6850'—The log illustrated a pronounced anodic slope indicative of inadequate cathodic protection and casing corrosion.
3) 6850' to 6800'—The log illustrated a pronounced cathodic slope indicating accumulating cathodic protection current and no corrosion.
4) 6800' to 5500'—The log illustrated a complete cathodic slope, increasing exponentially as it moved up the casing.

Figure 8:
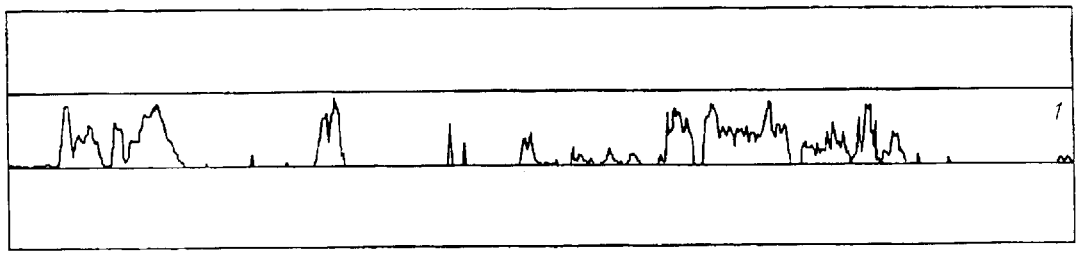
FIG. 8 is an Ultrasonic Imaging Tool (USI) log of the test of FIG. 7 of the downhole cathodic protection cable in accordance with the present invention.

FIG. 8 shows the results of the USI, which was run to determine the quality of the cement around the casing through a corrosive environment. The log revealed a decrease in cement bond quality in the corrosive region relative to the cement above and below the corrosive region.

The log was relatively clean from 4,800 feet below the surface down to 6,800 feet, with the top of the corrosive region at 6782 feet.

The CPET and USI logs confirm that severe external corrosion will occur on a well casing in a corrosive region without adequate cathodic protection, with the most sever corrosion near the bottom of the corrosive region and as a result of a "long line" interaction between the corrosive region and other formations. However, this corrosion is successfully mitigated by injecting 45 amps through the downhole cable connection.

This test was also successful in that it proved that the concept of attaching a downhole cathodic protection cable was valid and that this methodology may be used to introduce a cathodic protection current into two widely separated corrosive zones.

The equipment used in the test performed as expected, and any components designed for Power Water Injector wells may be adapted for other applications. For example, a more substantial surface casing exit system may be designed, and the penetrator may be modified so that it can be qualified at NEMA class 1 div. 1 explosion proof. The cable insulation may be made to ensure that the cable can be run in packer fluids, and an armored cable may be provided.

This technology may also be adapted to workover operations to provide remedial cathodic protection to existing wells. Such remedial cathodic protection may be compared with other existing technologies, such as external FBE coatings, to determine the most cost effective method for each application.

While the disclosed system and apparatus have been particularly shown and described with respect to the preferred embodiments, it is understood by those skilled in the art that various modifications in form and detail may be made therein without departing from the scope and spirit of the invention. Accordingly, modifications such as those suggested above, but not limited thereto are to be considered within the scope of the invention, which is to be determined by reference to the appended claims.

I claim:

1. A downhole cathodic protection cable system for providing cathodic protection to a metallic structure below the earth's surface, said system comprising:

an electrical connection structure approximately at the earth's surface;

an attachment shoe electrically connected to the metallic structure at a distance substantially below the earth's surface; and an electrical cable having first and second ends, said first end being connected to said connection structure and said second end being electrically connected to said attachment shoe, wherein said first end is electrically connectable through said connection structure to a cathodic current source for providing a cathodic protection current to the metallic structure at said attachment shoe, the cathodic protection current provided to the metallic structure at said attachment shoe being sufficient to render a portion of metallic structure extending at least hundreds of feet both above and below said attachment shoe negatively charged with respect to surrounding earth to thereby prevent substantial corrosion of the protected portion of the metallic structure.

2. The system of claim 1, wherein the distance of said attachment shoe below the earth's surface is greater than a distance at which a current supplied to the metallic structure at the earth's surface can effectively prevent substantial corrosion.

3. The system of claim 1, wherein the distance of said attachment shoe below the earth's surface is more than 1,000 feet.

4. The system of claim 1, wherein the distance of said attachment shoe below the earth's surface is on the order of thousands of feet.

5. The system of claim 1, wherein said attachment shoe provides a sturdy mechanical attachment of said second end of said cable to said metallic structure.

6. The system of claim 1, wherein the metallic structure includes a casing of a well, and wherein said attachment shoe is connected to the casing.

7. The system of claim 1, wherein the metallic structure includes an inner casing and an outer casing of a well, wherein said attachment shoe is connected to the inner casing, and wherein said cable runs between the inner and outer casings from said attachment shoe up to a point substantially at the earth's surface.

8. The system of claim 7, further comprising an outlet through the outer casing at the point substantially at the earth's surface, wherein said cable passes through said outlet from within the outer casing to reach said connection structure.

9. The system of claim 8, wherein said attachment shoe provides a sturdy mechanical attachment of said second end of said cable to said metallic structure.

10. The system of claim 9, wherein said attachment shoe is welded to the inner casing of the well, and said second end of said cable is connected to said attachment shoe by soldering.

11. A method of providing cathodic protection to a metallic structure below the earth's surface, said method comprising the steps of:

electrically connecting an attachment shoe to the metallic structure at a distance substantially below the earth's surface;

electrically connecting a second end of an electrical cable to the attachment shoe;

connecting a first end of the cable to a connection structure approximately at the earth's surface; and electrically connecting the second end of the cable through the connection structure to a cathodic current source for providing a cathodic protection current to the metallic structure at the attachment shoe, the cathodic protection current provided to the metallic structure at the attachment shoe being sufficient to render a portion of the metallic structure extending at least hundreds of feet both above and below the attachment shoe negatively charged with respect to the surrounding earth to thereby prevent substantial corrosion of the protected portion of the metallic structure above and below the attachment shoe.

12. The method of claim 11, wherein the distance of the attachment shoe below the earth's surface is greater than a distance at which a current supplied to the metallic structure at the earth's surface can effectively prevent substantial corrosion.

13. The method of claim 11, wherein the distance of the attachment shoe below the earth's surface is more than 1,000 feet.

14. The method of claim 11, wherein the distance of the attachment shoe below the earth's surface is on the order of thousands of feet.

15. The method of claim 11, wherein said step of electrically connecting the attachment shoe provides a sturdy mechanical attachment of the second end of the cable to the metallic structure.

16. The method of claim 11, wherein the metallic structure includes a casing of a well, and wherein said step of electrically connecting the attachment shoe connects the attachment shoe to the casing.

17. The method of claim 11, wherein the metallic structure includes an inner casing and an outer casing of a well, wherein said step of electrically connecting the attachment shoe connects the attachment shoe to the inner casing, and wherein the cable runs between the inner and outer casings from the attachment shoe up to a point substantially at the earth's surface.

18. The method of claim 17, further comprising the step of forming an outlet through the outer casing at the point substantially at the earth's surface, wherein the cable passes through the outlet from within the outer casing to reach the connection structure.

19. The method of claim 18, wherein said step of electrically connecting the attachment shoe provides a secure mechanical attachment of the second end of the cable to the metallic structure.

20. The method of claim 19, wherein said step of electrically connecting the attachment shoe includes the steps of welding the attachment shoe is welded to the inner casing of the well and soldering the second end of the cable to the attachment shoe.

* * * * *